United States Patent [19]

Rathnow et al.

[11] 3,984,087

[45] Oct. 5, 1976

[54] DEVICE FOR MIXING AND APPORTIONING LIQUIDS

[75] Inventors: Erich Rathnow, Bochum; Hans-Joachim Rasch, Herne, both of Germany

[73] Assignee: Klockner-Humboldt-Deutz Aktiengesellschaft, Germany

[22] Filed: Apr. 17, 1974

[21] Appl. No.: 461,722

[30] Foreign Application Priority Data

Apr. 27, 1973 Germany ..... 2321342

[52] U.S. Cl. ..... 259/4 R

[51] Int. Cl.[2] ..... B01F 5/06

[58] Field of Search ..... 259/4, 18, 36

[56] References Cited

UNITED STATES PATENTS 2,244,195 6/1941 Hasselbach ..... 259/18

FOREIGN PATENTS OR APPLICATIONS 961,521 6/1964 United Kingdom ..... 259/DIG. 17

*Primary Examiner*—Stanley N. Gilreath
*Assistant Examiner*—Alan Cantor
*Attorney, Agent, or Firm*—Hill, Gross, Simpson, Van Santen, Steadman, Chiara & Simpson

[57] ABSTRACT

A device for mixing and/or apportioning of pulps and similar liquids comprises a receiving chamber housing to the bottom end of which a pulp outlet housing is attached which is provided with discharge nipples. Said receiving chamber housing has an inlet and a bottom member provided with a plurality of apertures in communication with a plurality of outlet chambers in said outlet housing in such a manner that each of said outlet chambers is connected with said receiving chamber through at least one of said apertures.

7 Claims, 5 Drawing Figures

Figure 4:
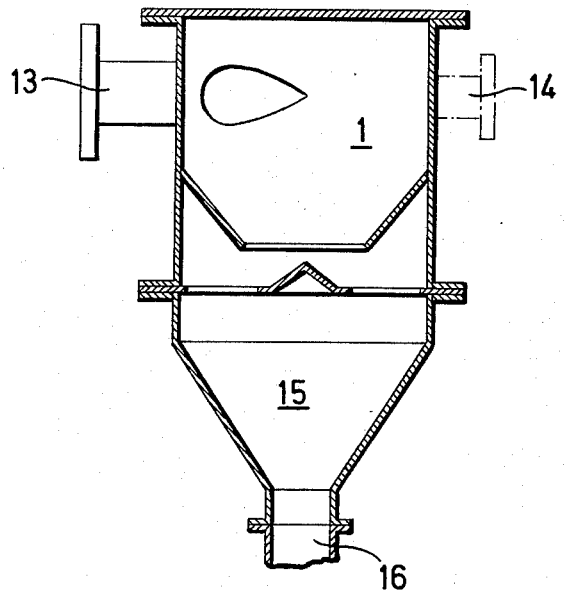

FIG. 1
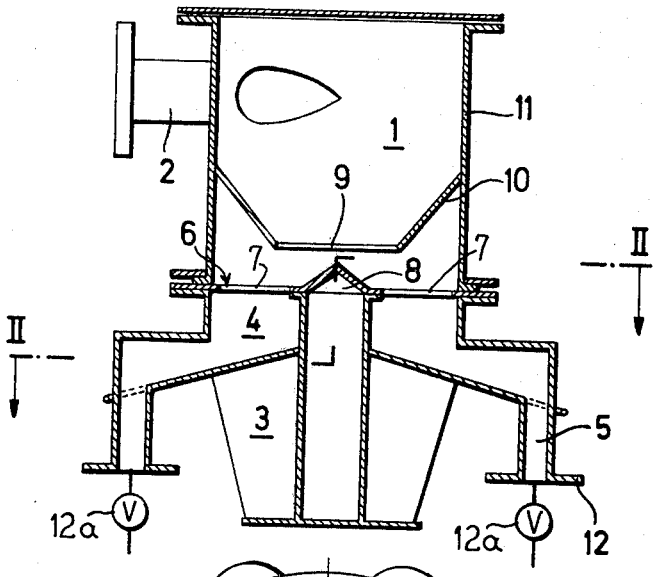
FIG. 2
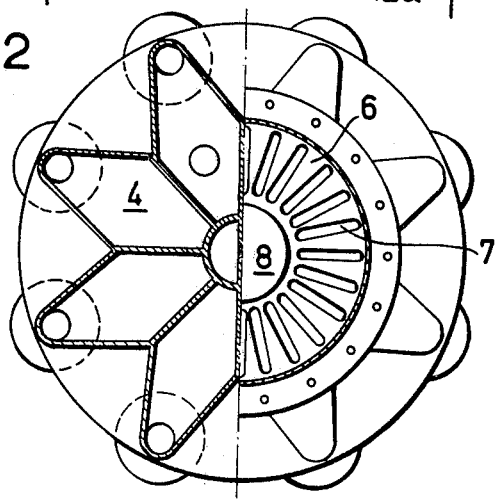
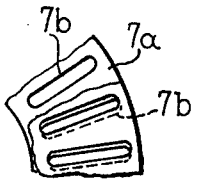
FIG. 2a

DEVICE FOR MIXING AND APPORTIONING LIQUIDS

This invention relates to a device for mixing and/or apportioning liquids, particularly pulps, said device comprising at least a receiver chamber with a pulp inlet, as well as a pulp outlet housing connected with said receiving chamber.

In the treatment technique pulp distributors are known in which the pulp is introduced from above into a receiving housing which is journaled on a pivot and driven from the outside. The pulp in the receiving chamber is withdrawn by centrifugal action through openings in the walls of the receiving chamber and sweeps on its way out through single chambers which are stationarily arranged around the rotating receiving chamber housing. The operation of such a pulp distributor is accompanied by a constant energy consumption and by wear and tear on all the rotating members. Furthermore, the heavy ingredients have depending upon the composition of the pulp a tendency to settle non-uniformly on the bottom of the rotating receiving housing so that due to changing moments of inertia considerable uncontrolled bearing loads occur. Additionally, a constant rotary speed which is necessary for maintenance of accurately divided pulp quantities, can be achieved only through continuous supervision and constant renewal of all wearing members.

The object of this invention is to provide a device for apportioning and/or mixing of liquids, particularly pulps, in which the disadvantages of the hitherto known pulp distributors can be lastingly avoided.

This object is according to the invention achieved by providing the bottom region of the receiving chamber with a plurality of openings and by providing in the pulp outlet housing a plurality of outlet chambers, at least one of said bottom openings establishing communication with one of the outlet chambers and each of said outlet chambers being provided with at least one discharge nipple. Through this arrangement it is achieved that the pulp supplied to the device becomes quantitatively accurately divided and continuously dischargeable through said discharge nipples without mechanical drive means, so that contary to conditions in prior art pulp distributors expensive drive assemblies apt to wear out and requiring supervision need not be provided.

By means of the structure of the invention it is feasible in a simple way to treat any quantity of pulp through free selection of the nominal pipe diameter of the pulp inlet and free selection of the number of discharge nipples from the outlet housing. Furthermore, it is with given dimensions of the device possible to adapt the same to the currently supplied pulp quantity by providing in the discharge nipples valves, slides or the like by the aid of which individual chambers may be completely shut off so that the quantitative distribution is variable within predetermined limits.

In an embodiment of the invention the receiving chamber is in its upper region provided with at least one inlet pipe which is tangentially directed. Through the tangential introduction of the pulp a whirling motion of the heavy ingredients is advantageously achieved, and thereby the formation of layers and deposits of the heavy ingredients is avoided and at the same time it is accomplished that after the distribution the same pulp composition can be maintained as prior to the introduction into the receiving chamber. Particularly in the case of pulps of different weights to be mixed with each other or in the case of pulps which while flowing considerable distances in pipes are apt to undergo heavier separation, the tangential introduction of the individual pulp quantities into a receiving chamber makes feasible a uniform mixing immediately prior to the distribution, with a minimum cost of structural elements.

In a further development of the invention the openings in the bottom region of the receiving chamber are in the form of slots, the longitudinal axes of which extend transversely of the flow direction of the pulp and have substantially equal sectional area. In this manner a uniform quantity is advantageously provided for eachc outlet chamber, and in spite of possible stratification or deposition occurrences the deviations from the optimal pulp mixing for all the chambers are uniformly distributed and thus compensated for. In the case of mutually equal size of the openings an advantageous simple control of the individual discharge quantities is possible by means of valves which may be provided in the discharge nipples. Within the framework of the invention the size of the openings may also be adjustable, whereby control of the distributed and discharged pulp quantities per chamber is also feasible.

In a further embodiment of the invention a conical deflection member is disposed at the middle of the bottom. By means of said member those quantities of pulp are also uniformly distributed over the region of the openings, which in spite of the tangential introduction due to the influence of the force of gravity flow directly through the receiving chamber from above and downwardly.

In a particularly advantageous embodiment of the invention the bottom of the receiving chamber is in the form of a removable disc. The feature represents a particularly simple structural arrangement of the distribution device, since thereby the receiving chamber housing, the bottom disc and the outlet chamber housing are readily connectible and disconnectible, and since also depending upon the composition of the pulp or the stage of wear other distribution discs with different dividing patterns, or new deflection members may be inserted.

According to the invention the receiving housing is below the pulp inlet provided with a distribution shield which is secured to the wall of the receiving chamber and tapers conically in the flow direction, said distribution shield being coaxial with the chamber and having its outlet as a distance above the bottom region thereof. Through this feature the frictional flow losses of the incoming pulps are advantageously balanced, so that the velocity at which the pulp is discharged from the shield opening is approximately the same as the inlet velocity. Hereby separations during the passage through the receiving chamber are largely avoided and optimal mixing conditions are accomplished up to the immediate distribution through the divider disc and also after the discharge from the outlet chambers. In particular, it is hereby achieved that a thorough mixing occurs due to the intense whirling movements in the case of introduction of a number of pulps of different weight.

A further feature of the invention is that the bottom region of the receiving chamber is shaped as a deflection means. This structural feature permits a simple and advantageous construction which is particularly suitable for standardized apportioning devices or receiving housings.

Figure 3:
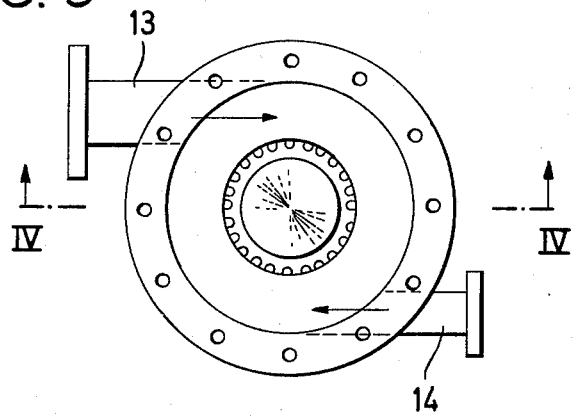

Further details, features and advantages of the invention are described below with reference to the accompanying diagrammatic drawings which show embodiments of the invention, in which:

FIG. 1 is a diagrammatic illustration of a first embodiment of the device in vertical section, FIG. 2 is a cross-sectional view along line II—II in FIG. 1, FIG. 2*a* is a fragmentary view of a modified form of structure of FIGS. 1 and 2, FIG. 3 shows a second embodiment of the invention in vertical section, and FIG. 4 shows a section along line IV—IV in FIG. 3.

The device shown in FIGS. 1 and 2 for mixing and/or apportioning of liquids, particularly pulps, comprises a receiving housing 1 in the upper region of which an inlet nipple 2 is tangentially arranged. To the receiving housing 1 an outlet housing 3 is attached by means of joined flanges, said outlet housing being divided into a number of outlet chambers 4, each provided with a discharge nipple 5. Between the receiving housing 1 and the outlet housing 3 a divider disc 6 is disposed which is provided with a plurality of apertures 7 which according to the invention preferably are in the form of slots having their longitudinal axes disposed transversely of the flow direction of the pulp and all having the same sectional area. The divider disc 6 is disposed between the receiving housing 1 and the outlet housing 3 and is preferably removable. Centrally of the divider disc 6 a conical deflection member 8 is arranged with has its base in the region of the apertures 7. Each of the outlet chambers 4 communicates through at least one of the apertures 7 with the receiving chamber 1. The bottom members of the outlet chambers 4 are for the purpose of facilitating the outwardly flow of the pulp preferably inclined from the center toward the discharge nipples 5.

The deflection member 8 which is rigidly connected with the divider disc 6, extends with its conical tip into the opening area 9 of a tapered distribution shield 10 which above the divider disc 6 and below the inlet pipe 2 is secured to the wall 11 of the receiving chamber 1.

For the purpose of control the area of the apertures 7 in the divider disc 6 may according to the invention be varied by means of a shutter disc (not shown) which adjustably covers at least a portion of the elongate slots, so that the total area of the apertures is always adaptable to the quanity of pulp admitted and distributed. It is also advantageous to arrange in the region of the outlet nipples 5 a suitable number of valves, slides or the like by means of which individual outlet chambers 4 may be completely shut off so that the total pulp quantity is uniformly divided among the remaining open outlet chambers 4.

In operation, the entire amount of the liquid or pulp to be apportioned is according to FIGS. 1 and 2 through the inlet nipple 2 introduced tangentially into the receiving chamber 1, flows with intensive whirling movement and annular circulation along the chamber wall 11 downwardly into the distribution shield 10, and is discharged from the opening region 9 of said shield in a substantially tangential direction and thoroughly mixed. By the conical deflection member 8 the pulp is uniformly passed across the bottom of the receiving chamber 1 which is formed by the divider disc 6. The pulp flowing through the slot-shaped apertures 7 passes uniformly and with avoidance of layer formation through said apertures 7 into the outlet chambers 4 and then along the inclined chamber bottoms to the respective outlet nipples 5 which are provided with connection flanges 12.

In case the pulp quantities to be apportioned are not supplied to the receiving chamber 1 with constant timing, it iw within the framework of the invention feasible to uniformly vary the open area of the apertures 7 by means of a shutter disc in such a manner that the total free aperture area to the outlet chambers 4 is at all times adapted to the furnished quantity of pulp. FIG. 2*a* shows such a shutter disc at 7*a* having apertures at 7*b*. By means of valves, slides or the like, provided in the discharge nipples 5 or at the connection flanges 12 (indicated schematically at 12*a* in FIG. 1), it is also feasible to completely shut off individual chambers so that said individual chambers are filled withh liquid, and the overflow from said closed chambers may be uniformly apportioned to the others chambers. In the case of pulps whhich due to a high proportion of heavy ingredients are apt to form deposits, it is within the framework of the invention to alternately shut off and open individual outlet chambers so that the deposited heavy ingredients are prevented from becoming too set, whereby damage to the shut off members is avoided.

In many cases in the treatment technique the problem is also encountered to intimately mix different liquids, particularly pulps with different contents of dense ingredients. For example, in the process of classifying raw mineral coals according to the wet settling method by means of pulps containing heavy material, the problem is encountered of continuously withdrawing a percentage proportion of said pulp, to free it from heavily abrasive material and to return it to the process. Suitably, for this purpose in a further embodiment of the invention a mixing device as shown in FIGS. 3 and 4 is utilized. The refined pulp proportion is in this case introduced tangentially through by-pass nipples 14 into the receiving chamber 1, while the remaining part of the heavy pulp is supplied through a likewise tangentially arranged main inlet nipple 13. As described above, the amounts of pulp are intimately mixed with each other, flow into an outlet cone 15 and are withdrawn through a discharge nipple 16 from the inventive mixing device and the dense pulp separator, for example a two-product separator for separating the raw coal into fine coal and waste or refuse.

The use of a device for mixing and/or apportioning liquids, particularly pulps, according to the invention is not limited only to the accurate apportioning of liquid to the individual outlet nipples. On the contrary, mixing and/or apportioning of flowable material of any composition, such as fine-grained fluidized solid materials, are feasible. With a device according to the invention it is also possible to effect an apportioning of the liquid into labratory-suited test samples in that, for example, to one of the discharge nipples 5 a second device according to the invention is connected for additional apportioning of the liquid, at least one of said discharge nipples being connected to a device for withdrawal of the test sample, while the other discharge nipples are connected with a common return conduit. The results of the withdrawn test samples may, for example, serve for control of a treatment process or if a plurality of pulps of different dense material contents are introduced into the receiving chamber 1 of the inventive device, said test samples may be utilized as regulating means in order to adapt the quantitative proportions of the individual pulps to each other for achieving optimal predetermined mixing conditions.

We claim as our invention:

1. A device for mixing and apportioning liquids such as pulps comprising:

a collection housing havng a receiving chamber with an inlet;

an outlet housing positioned below said collection chamber housing;

a plurality of outlet chambers in said outlet housing;

a separate discharge passage leading downwardly from each of said outlet chambers;

and a bottom member in said receiving chamber positioned above the outlet housing provided with a plurality of apertures spaced above the outlet chambers so that material discharges downwardly to be received by the outlet chambers with at least one of said apertures discharging into each receiving chamber;

said apertures comprising elongate slots of equal size having their longitudinal axes directed transversely of the pulp flow direction.

2. A device for mixing and apportioning liquids such as pulps comprising:

a collection housing having a receiving chamber with an inlet;

an outlet housing positioned below said collection chamber housing;

a plurality of outlet chambers in said outlet housing;

a separate discharge passage leading downwardly from each of said outlet chambers;

a bottom member in said receiving chamber positioned above the outlet housing provided with a plurality of apertures spaced above the outlet chambers so that material discharges downwardly to be received by the outlet chambers with at least one of said apertures discharging into each receiving chamber;

and a conical deflection member disposed in the center of said receiving chamber bottom.

3. A device for mixing and apportioning liquids such as pulps comprising:

a collection housing having a receiving chamber with an inlet;

an outlet housing positioned below said collection chamber housing;

a plurality of outlet chambers in said outlet housing;

a separate discharge passage leading downwardly from each of said outlet chambers;

and a bottom member in said receving chamber positioned above the outlet housing provided with a plurality of apertures spaced above the outlet chambers so that material discharges downwardly to be received by the outlet chambers with at least one of said apertures discharging into each receiving chamber;

said receiving chamber bottom comprising a removable disc.

4. A device according to claim 3, in which said receiving chamber is below said inlet and said deflection member tapers in the flow direction and is secured to the receiving chamber wall and has its opening at a distance above the bottom region of said receiving chamber.

5. A device for apportioning fluid material comprising:

a circular receiving chamber having an inlet means;

a circular chamber below said receiving chamber and in communication therewith;

means defining a plurality of outlet passages leading from the lower end of said outlet chamber with said passages of uniform size and uniformly spaced circumferentially relative to the axis of said chambers and uniformly spaced in a radial direction;

a plate means between said chambers having flow openings uniformly spaced in circumferential and radial directions relative to the axis of said chamber, said plate means spaced above said outlet passages so that material will drop downwardly through the plate flow openings in a uniformly distributed pattern and the pattern will be separated into separate flows for each of said passages;

and means for controlling the size of said flow openings in said plate means.

6. A device for apportioning fluid material comprising:

a circular receiving chamber having an inlet means;

a circular outlet chamber below said receiving chamber and in communication therewith;

means defining a plurality of outlet passages leading from the lower end of said outlet chamber with said passages of uniform size and uniformly spaced circumferentially relative to the axis of said chambers and uniformly spaced in a radial direction;

a plate means between said chambers having flow openings uniformly spaced in circumferential and radial directions relative to the axis of said chambers, said plate means spaced above said outlet passages so that material will drop downwardly through the plate flow openings in a uniformly distributed pattern and the pattern will be separated into separate flows for each of said passages;

and means in said receiving chamber for directing the fluid material to the center of the receiving chamber.

7. A device for apportioning fluid material constructed in accordance with claim 6 and including means for again directing the fluid material radially outwardly toward the flow openings in said plate means.

* * * * *